US009951448B2

(12) United States Patent
Sommer et al.

(10) Patent No.: US 9,951,448 B2
(45) Date of Patent: Apr. 24, 2018

(54) APPARATUS FOR THE CONTINUOUS MANUFACTURE OF A SPUNBOND WEB

(71) Applicant: Reifenhaeuser GmbH & Co. KG Maschinenfabrik, Troisdorf (DE)

(72) Inventors: Sebastian Sommer, Troisdorf (DE); Harald Markes, Bruchhausen (DE); Alexander Klein, Pracht (DE); Emin Oezgoeren, Troisdorf (DE); Felix Goretzki, Troisdorf (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 482 days.

(21) Appl. No.: 14/621,787

(22) Filed: Feb. 13, 2015

(65) Prior Publication Data

US 2015/0299921 A1 Oct. 22, 2015

(30) Foreign Application Priority Data

Feb. 17, 2014 (EP) ..... 14155442

(51) Int. Cl.
*D04H 3/16* (2006.01)
*D01D 5/092* (2006.01)
(Continued)

(52) U.S. Cl.
CPC ..... *D04H 3/16* (2013.01); *D01D 5/092* (2013.01); *D01D 5/0985* (2013.01); *D01D 5/12* (2013.01);
(Continued)

(58) Field of Classification Search
CPC ..... D01D 5/092; D01D 5/12; D01D 5/14; D01D 11/00; D01D 11/04; D04H 3/02; D04H 3/16; D04H 3/163; D04H 3/166
See application file for complete search history.

(56) References Cited

U.S. PATENT DOCUMENTS 3,314,122 A * 4/1967 Bundy ..... D04H 3/03 156/167
5,762,857 A 6/1998 Weng et al.
(Continued)

FOREIGN PATENT DOCUMENTS

DE 102005049784 A1 4/2007
DE 102008051836 A1 4/2010
EP 1424420 A1 6/2004

*Primary Examiner* — Alison L Hindenlang
*Assistant Examiner* — Joseph S Leyson
(74) *Attorney, Agent, or Firm* — Andrew Wilford

(57) ABSTRACT

An apparatus for the continuous manufacture of a spunbond web from aerodynamically stretched thermoplastic filaments has at least one spinneret, a cooling chamber for cooling the filaments, a stretcher, and a deposition device for the deposition of the filaments to form the spunbond web. At least one filament guide having a plurality of filament-guide gaps opens toward the stretcher between the stretcher and the deposition device, and the filament guide or at least one guide part of the filament guide can be moved such that the filament-guide gap or the stretcher-side openings thereof are displaced transversely to the travel direction of the spunbond web. Thus the filaments or filament bundles guided along or through the filament-guide gap are given a transverse orientation to the travel direction of the spunbond web when deposited onto the deposition device.

17 Claims, 5 Drawing Sheets

(51) Int. Cl.

| | |
|---|---|
| ***D01D 5/14*** | (2006.01) |
| ***D01D 11/00*** | (2006.01) |
| ***D04H 3/005*** | (2012.01) |
| ***D04H 3/02*** | (2006.01) |
| ***D01D 5/12*** | (2006.01) |
| ***D01D 11/04*** | (2006.01) |
| ***D01D 5/098*** | (2006.01) |

(52) U.S. Cl.
CPC ..... *D01D 5/14* (2013.01); *D01D 11/00* (2013.01); *D01D 11/04* (2013.01); *D04H 3/005* (2013.01); *D04H 3/02* (2013.01)

(56) References Cited

U.S. PATENT DOCUMENTS

| | | | | |
|---|---|---|---|---|
| 6,379,136 | B1 | 4/2002 | Najour et al. | |
| 6,918,750 | B2 | 7/2005 | Geus | |
| 2003/0077430 | A1 | 4/2003 | Grimm et al. | |
| 2003/0161904 | A1 | 8/2003 | Geus et al. | |
| 2006/0040008 | A1 | 2/2006 | Geus et al. | |
| 2006/0172024 | A1* | 8/2006 | Bentley | D01D 5/0985 425/72.2 |
| 2006/0202383 | A1* | 9/2006 | Stundl | D04H 3/03 264/211.14 |
| 2008/0317895 | A1* | 12/2008 | Boscolo | D04H 3/03 425/382.2 |

* cited by examiner

Fig.2
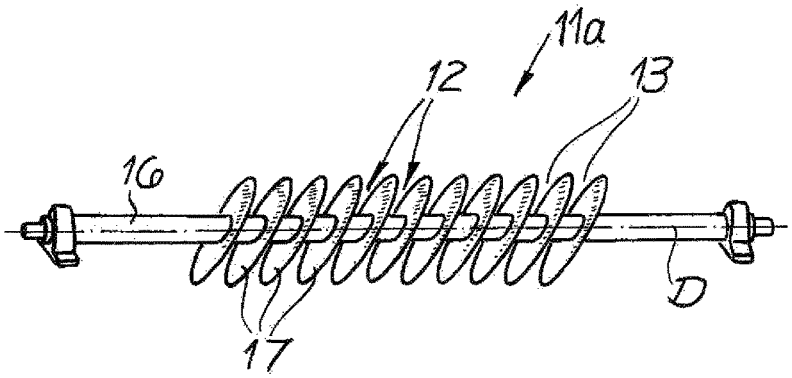
Fig.3A
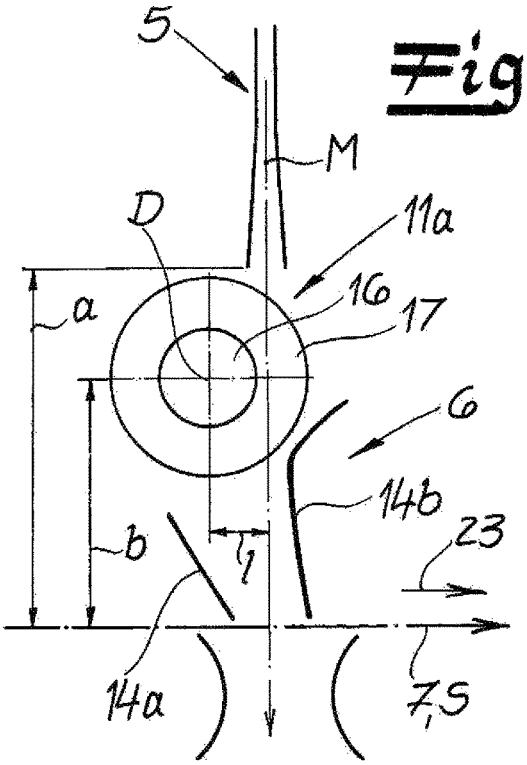
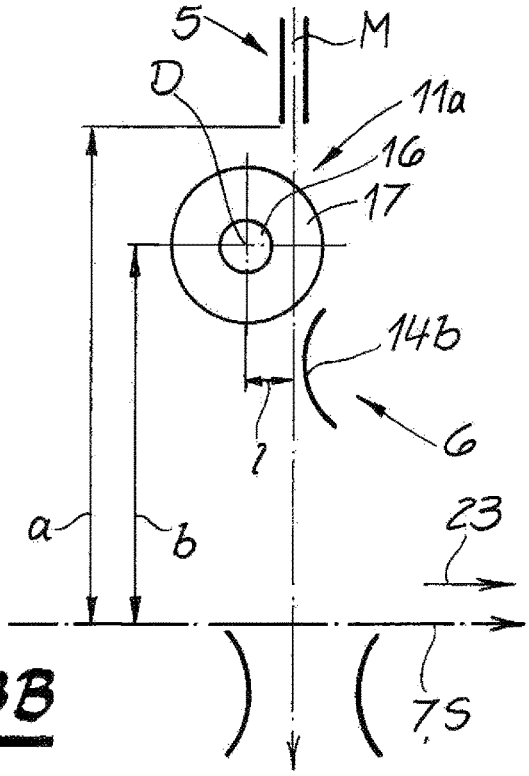
Fig.3B

Fig.5
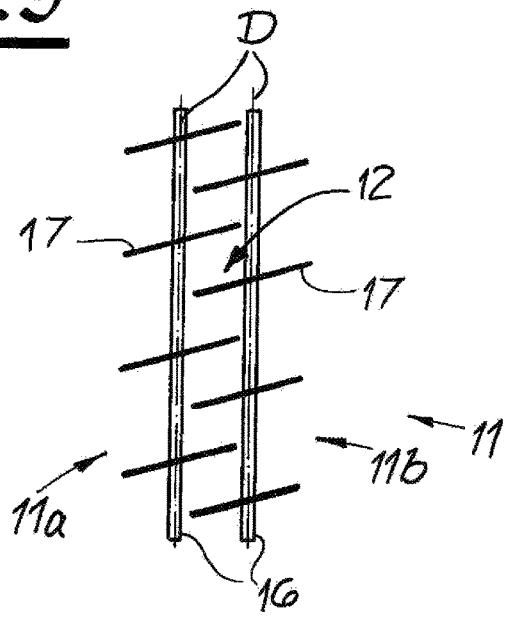
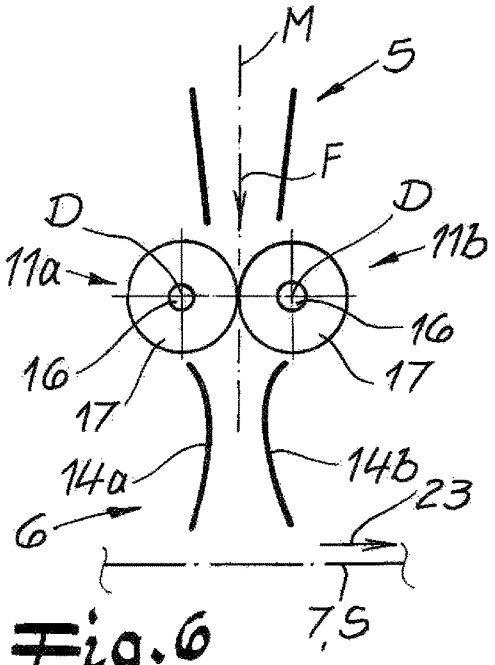
Fig.6
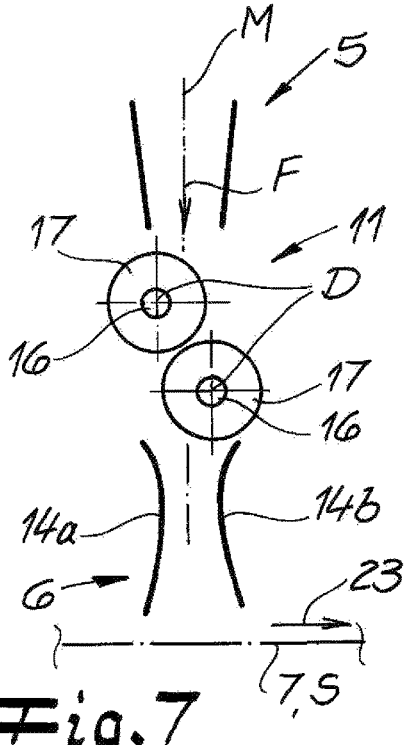
Fig.7

APPARATUS FOR THE CONTINUOUS MANUFACTURE OF A SPUNBOND WEB

FIELD OF THE INVENTION

The invention relates to an apparatus for the continuous manufacture of a spunbond web from aerodynamically stretched filaments, preferably from thermoplastic plastic.

BACKGROUND OF THE INVENTION

An apparatus of the above-described type is basically known from practical applications. In this connection, it has been proven effective to spin, cool, and stretch the filaments with a spinner and, after expanding the thus produced filament bundle, to then form the spunbond web by depositing the filaments on a deposition device that is usually an endless conveyor belt. In the apparatus known from practical applications, the spunbond web that has been deposited onto the conveyor belt is subjected to additional processing steps. Many spunbond fabrics produced with the known measures leave much to be desired with respect to their mechanical properties, in particular, such as tensile strengths, tear propagation resistances, isotropy, dimensional stability, etc. This is due, in particular, to the fact that the filaments, when deposited, tend to become oriented in the travel direction of the spunbond web (machine direction, MD) rather than transversely to the travel direction (transversely to the machine direction, CD). As a result, the deposited filaments have different properties in the machine direction than transversely to the machine direction, which is unwanted, for example the deposited filaments have less strength transversely to the machine direction than in the machine direction. This also affects other mechanical properties, such as the dimensional stability of the nonwoven, the tear propagation resistance, and others. Such a nonisotropic deposition also occurs when a diffuser is used, or when diffusers are used within the framework of a deposition unit between the stretcher and the deposition device. Certain needle-punching measures for consolidation the nonwoven web can increase these disadvantageous effects even further. Isotropic properties, i.e. properties that are the same, are desirable, however, primarily in nonwoven products for technical use, in particular, the same strengths of the nonwoven in the machine direction (MD) and transversely to the machine direction (CD). In the past, special needle-punching techniques were used in order to obtain better isotropic results. For example, a needle-punching device having a so-called hyperpunch variant was used, where a vertical displacement as well as a horizontal displacement of the needle board takes place. The result obtained therewith left much to be desired, however, not to mention that such needle-punching devices are complex and expensive. The known measures therefore require improvement.

OBJECT OF THE INVENTION

The object of the invention is therefore to provide an apparatus of the above-mentioned type with which isotropic properties of the nonwoven web or the spunbond fabric can be obtained in the machine direction (MD) and transversely to the machine direction (CD) in a simple, low-cost, and functionally reliable manner. The object, in particular, is to obtain identical or substantially identical strength properties in the machine direction (MD) and transverse to the machine direction (CD).

Another object of the invention is to provide a corresponding product and/or a corresponding spunbond web.

SUMMARY OF THE INVENTION

To attain the object, the invention provides an apparatus for the continuous manufacture of a spunbond web (S) from filaments, in particular aerodynamically stretched filaments—preferably from thermoplastic plastic using a spinneret, a cooling chamber for cooling the filaments, a stretcher, and a deposition device for the deposition of the filaments to form the spunbond web, where at least one filament guide having a plurality of filament-guide gaps open toward the stretcher is provided between the stretcher and the deposition device, wherein the filament guide or at least one guide part of the filament guide can be moved such that the filament-guide gap or the stretcher-side openings thereof are displaced in particular transversely to the travel direction of the spunbond web such that the filaments or filament bundles guided along or through the filament-guide gap are given an (additional) transverse orientation to the travel direction of the spunbond web when deposited on the deposition device. It lies within the scope of the invention that the filaments are endless filaments that are produced using a spunbond process.

The conveyance or travel direction of the spunbond web means, in particular, the travel direction of the deposition device. Preferably at least one conveyor belt is used as the deposition device. It lies within the scope of the invention that the filaments are initially produced as a filament curtain or filament curtain that is continuous or substantially continuous transversely to the travel direction. It also lies within the scope of the invention that the stretcher has a continuous stretching gap that is elongated transversely to the travel direction for this purpose. This stretching gap advantageously extends at least across the greatest portion of the width of the deposited spunbond web transversely to the travel direction. The filament guide according to the invention or the filament-guide gaps thereof separate filaments or filament bundles from the continuous filament curtain that are influenced and/or redirected according to the invention and are deposited on the deposition device accordingly.

Monocomponent filaments and/or multicomponent filaments or bicomponent filaments can be used as filaments within the scope of the invention. Preferably, the filaments substantially comprise a thermoplastic plastic, for example made of a polyolefin, preferably of polyethylene and/or polypropylene or a polyester or a polyamide. According to one embodiment, the filaments have a titer of at least 1 denier, preferably of at least 1.5 denier. It is recommended that the spunbond web has a basis weight of at least 20 g/m$^2$, preferably at least 40 g/m$^2$ and, according to one embodiment, at least approximately 50 g/m$^2$, for example.

It lies within the scope of the invention that the cooling air fed into the cooling chamber can be supplied from an air supply chamber. According to one embodiment of the invention, the air supply chamber has at least two or only two compartments disposed vertically one above the other. From these compartments, the cooling chamber can supply cooling air having different temperatures. According to a particularly preferable embodiment, which is particularly significant within the scope of the invention, an assembly comprising the cooling chamber and the stretcher—apart from the air supply in the cooling chamber—forms a closed system. Basically, however, it is also possible to work with a so-called open system. It is recommended that the deposition device of the apparatus is a conveyor belt or an endlessly circulating conveyor belt. The filaments are emitted by the spinneret and are preferably guided along a vertical or substantially vertical flow path from the spinneret to the deposition device or the conveyor belt. The vertical or substantially vertical filament curtain/filament curtain undergoes a deflection in the filament guide according to the invention.

It lies within the scope of the invention that the filaments emerging from the stretcher are divided into filament bundles by the filament guide or by the filament-guide gaps of the filament guide. Furthermore, it lies within the scope of the invention that these filament bundles are guided through the filament-guide gaps. It is recommended that the filament guide or at least one guide part of the filament guide has more than two, preferably more than three and, particularly preferably, more than four filament-guide gaps or a corresponding number of upstream openings of the filament-guide gaps. Advantageously, plates for the filament-guide gap are connected to the filament guide or at least to at least one guide part of the filament guide. By means of the filament guide according to the invention or by the filament-guide gaps thereof, a deflection, in particular, of the filaments or the filament bundles guided through the filament-guide gap transversely to the travel direction of the spunbond web is achieved. To this end, the filament-guide gaps are displaced and, in particular, are displaced transversely to the travel direction of the spunbond web. It lies within the scope of the invention that, in order to displace the filament-guide gaps or to displace the upstream openings thereof, the filament guide or at least one guide part—and according to one embodiment a plurality of guide parts of the filament guide—is/are moved. Movement of the filament guide or the guide part(s) thereof can take place continuously and/or in steps. Preferably, the number and/or the frequency of the displacements of the filament-guide gap or the upstream openings thereof can be adjusted. The movements of the filament guide or at least one guide part of the filament guide can be carried out as rotation movements and/or as translatory movements. These possible movements are explained in greater detail further below with reference to illustrated embodiments. According to a proven embodiment of the invention, the filament guide or at least one guide part of the filament guide can be displaced or shifted horizontally and/or vertically between the stretcher and the deposition device.

It lies within the scope of the invention that the filament guide or at least one guide part of the filament guide can be moved in a periodic manner. It also lies within the scope of the invention that the filament-guide gap or the upstream openings thereof can therefore also be moved or displaced in a periodic manner. According to a preferred embodiment, the movement of the filament guide or at least one guide part of the filament guide or the displacement of the filament-guide gap takes place as an oscillation, and, as recommended, as a symmetrical oscillation. Advantageously, the filament-guide gaps or the upstream openings thereof each move from a neutral position (central position) in which position the filaments or filament bundles can be advantageously directed, without deflection or substantially without deflection, onto the deposition device. Preferably, the frequency of the displacement of the filament-guide gap can be adjusted. The frequency of the oscillation or displacement of the filament-guide gap advantageously amounts to 5 to 40 Hz, preferably 10 to 30 Hz and, particularly preferably, 15 to 20 Hz.

It is recommended that the filament guide or at least one guide part of the filament guide is 100 mm to 800 mm, preferably 200 mm to 500—advantageously vertically—below the stretcher. It lies within the scope of the invention that the filament-guide gaps of a filament guide or of a guide part of the filament guide are at the same vertical level or substantially at the same vertical level. It is recommended that the filament-guide gaps are thereby disposed next to one another transversely to the flow direction of the filaments. According to a preferred embodiment, a filament-guide gap has a width of 30 to 200 mm and, preferably, a width of 80 to 150 mm.

According to a preferred embodiment of the invention, the at least one filament guide is designed such that filaments or filament bundles are deflected from the edge region or from the edge regions of the filament curtain in the direction of the center of the filament curtain. To this end, a special guide part of the filament guide can be provided, or the filament guide or at least one guide part of the filament guide has a particular design for this purpose in the edge region or edge regions thereof. This ensures that filaments or filament bundles that were deposited over the desired edge of the spunbond web are deflected in the direction of the center of the spunbond web such that a homogeneous deposition of filaments up to the desired edge of the spunbond fabric is achieved. As a result, the basis weight of the spunbond web can be held constant.

It has proven to be effective that the filament guide has at least one rotatable or rotating shaft with at least one flat disk connected to this shaft and where this at least one disk forms the side wall of at least one filament-guide gap. At least one guide part of the filament guide is then a rotatable or rotating shaft. According to one embodiment, the at least one shaft can rotate continuously in one direction, either clockwise or counterclockwise. According to another embodiment, the at least one shaft executes a reciprocating rotation movement. In this connection, the at least one shaft is initially rotated through a certain angle in one direction of rotation and is then rotated—advantageously through a neutral position—about angle in the other direction of rotation, and repeats this continuously. Both embodiments are explained in greater detail below with reference to specific illustrated embodiments.

A preferred embodiment of the invention is characterized in that the filament guide has at least one rotatable or rotating shaft that is transverse to the travel direction of the spunbond web, and a plurality of disks is connected to the shaft and the filament-guide gaps are formed between these disks. It is recommended that lines extending from different points of the outer edge or the outer edge region of a disk perpendicular to the rotation axis of the shaft preferably intersect the rotation axis of the shaft at different points. The outer region of the disk refers, in particular, to the radial outer one-third of the disk. It lies within the scope of the invention that the at least one shaft extending transversely to the travel direction rotates continuously in one direction of rotation, i.e. either clockwise or counterclockwise. The at least one rotating shaft is a guide part of the filament guide. According to one variant embodiment, the at least one shaft that is oriented transversely to the travel direction can be perpendicular or substantially perpendicular to the travel direction of the spunbond web. It lies within the scope of the invention that the at least one shaft extends along the stretching chute or is parallel/substantially parallel to the stretching chute. According to one variant embodiment, the at least one shaft can rotated by a drive. It also lies within the scope of the invention that, in addition or as an alternative, the rotatable shaft is driven by the process air flowing in the direction of the flow path of the filaments. Advantageously, the rotation speed of the rotating shaft can be adjusted. It is recommended that the disks connected to the at least one shaft are rigid and fixed to the shaft. Preferably, the disks rotate around with the shaft. According to a proven embodiment, the rotation axis of the shaft is in the center point of the disks or approximately in the center point of the disks. The disks are preferably round, in particular oval or circular. It lies within the scope of the invention that the surface of each of the disks is transverse to the shaft or transverse to the rotation axis of the shaft. According to one embodiment of the invention, the surface of the disks is planar. The surface of the disk can also be arched or curved, however.

It lies within the scope of the invention that the disk surfaces of the disks that are connected to the at least one shaft, which rotates transversely to the travel direction, form the side walls of the filament-guide gaps. As explained above, it also lies within the scope of the invention that the vertical lines extending from different points of the outer circumference and/or the outer region of the disks to the rotation axis of the shaft have different intersection points with the rotation axis of the shaft. Advantageously, a large number of such different imaginary intersection points is realized. —A very particularly preferred embodiment of the invention is characterized in that at least a portion of the disks that are connected to a shaft, which rotates transversely to the travel direction, or the majority of the surfaces of these disks is at a slant or is tilted to the rotation axis of the shaft. Preferably, all disks that are connected to such a rotating shaft are oriented at a slant or are tilted to the rotation axis. A majority of the disk surface means more than 50%, preferably more than 60%, and particularly preferably more than 75% of the disk surface. Advantageously, the disks that are at a slant or a tilt are flat and round. According to a recommended variant embodiment, the entire or substantially the entire surface of the disks is oriented at a slant to the rotation axis of the shaft. It lies within the scope of the invention that the angle between a disk and the rotation axis of the shaft is not equal to 90° and, advantageously, is between 10 and 70°, preferably between 20 and 60° and, particularly preferably, between 20 and 40°. Preferably, at least a portion of the disks is parallel to one another or substantially parallel to one another and, particularly preferably, all disks connected to a shaft are parallel to one another or substantially parallel to one another. It is recommended that the spacing between two disks or the spacing between the connection regions of two disks to the shaft is 30 to 200 mm, preferably 50 to 150 mm.

It lies within the scope of the invention that the filaments of the filament curtain emerging from the stretcher are guided through the filament-guide gap formed between the disks of the shaft or the shafts and that the filament curtain is thereby divided into filament bundles. In the case of angled/tilted disks, in particular, rotating the at least one shaft that is transverse to the travel direction displaces the upstream openings of the filament-guide gap formed between the disks such that the filament bundles guided through the tilted disks are deflected transversely to the travel direction of the spunbond web and are thereby provided with an additional transverse orientation for the deposition onto the deposition device. When the shaft rotates, the filament-guide gaps formed between the disks form reciprocating flow passages for the filaments or filament bundles that preferably oscillate or are deflected (center-right-center-left-center) with each rotation of the shaft. A guide vane system is obtained in this manner in which the locations where the disks project into the filament curtain are not stationary along the length of the shaft or the shafts, but rather oscillate laterally. In this manner, different filaments or filament bundles are continuously separated from the filament curtain by the disks or by the filament-guide gaps. As a result, an effective deflection of the filaments or filament bundles and, therefore, an additional transverse orientation of the filaments upon deposition thereof is achieved. A portion of the filaments comes into contact with the disks and is thereby deflected. Another portion of the filaments is carried along in the deflected process air stream, without having contact with the disks, and is deflected in this manner. As explained above, it lies within the scope of the invention that the at least one shaft can rotate in the direction of flow of the filaments or can rotate opposite the direction of flow of the filaments. It also lies within the scope of the invention that the rotation speed of the shaft can be adjusted. According to a recommended embodiment, the rotation speed of the shaft is in a range of 200 to 2000 revolutions/minute and preferably in a range of 500 to 1500 revolutions/minute. Advantageously, the rotation speed of the shaft can be changed within these ranges. The shaft can have a rotation speed of 1000 to 1200 revolutions/minute, for example. Advantageously, the peripheral speed of the at least one shaft is selected depending on the filament speed/filament speed of the flowing filaments. The peripheral speed of the at least one shaft should be slower than the filament speed in order to prevent the filaments or filament bundles from winding onto the shaft. According to a particularly preferred embodiment, at least one deflection of the filaments transversely to the travel direction takes place with each revolution of the at least one shaft. Basically it is also possible that a plurality of deflections of the filaments or filament bundles can take place with each revolution of a shaft, in particular when the disks or disk surfaces are curved or arched. It lies within the scope of the invention that the number or frequency of deflections of the filaments or filament bundles can be adjusted by adjusting the rotation speed of a shaft. By adjusting the rotation speed of the shaft, the number of displacements of the filament-guide gaps or the upstream openings thereof can be adjusted and, therefore, so can the number/frequency of deflections of the filaments/filament bundles.

It lies within the scope of the invention that the at least one rotating shaft extending transversely to the travel direction of the spunbond web, can be displaced and/or shifted horizontally and/or vertically. In this manner, the effect of the transverse orientation can be further influenced or controlled. In addition, it lies within the scope of the invention that the number and/or spacing and/or inclination angle and/or diameter of the disks connected to the at least one rotating shaft extending transversely to the travel direction, in the edge regions of the shaft can differ from the center of the shaft. The edge region of the shaft refers, in particular, to an edge region that corresponds to one-eighth to one-fourth of the length of the shaft.

At least one rotatable or rotating shaft extending transversely to the travel direction and has connected disks was mentioned above. According to one embodiment of the invention, a plurality of such shafts can be provided between the stretcher and the deposition device. The embodiments/variant embodiments described above in this context can be realized individually, partially in combination, or in combination in each of these shafts. Illustrated embodiments of embodiments comprising a plurality of shafts are described in greater detail further below.

A particularly preferred embodiment of the invention is characterized in that only one rotatable/rotating shaft, to which disks are connected and that is transverse to the travel direction, is provided between the stretcher and the deposition device. Advantageously, the rotation axis of this one shaft is offset vertically of the filament curtain emerging from the stretcher and, in fact, is such that the filaments or filament bundles are guided through the filament-guide gaps formed between the disks of the shaft. These filament-guide gaps of the shaft are then preferably open toward the outside. The shaft can rotate clockwise or counterclockwise. It lies within the scope of the invention that one deflection of the filaments or filament bundles takes place with each revolution of this shaft.

According to a further embodiment of the invention, the filament guide has at least two rotatable or rotating shafts extending transversely to the travel direction of the spunbond web, and a plurality of disks is connected to each of these shafts. In this embodiment, at least two or definitely two shafts or at least two or definitely two guide parts therefore form the filament guide. The two shafts can rotate in the same direction of rotation or in opposite directions of rotation. The rotation of each of the two shafts can take place clockwise or counterclockwise. It lies within the scope of the invention that the filament guide comprising the at least two shafts can be displaced or shifted in the horizontal and/or vertical direction between the stretcher and the deposition device. According to one variant embodiment, the phase angle of the rotation drive of one shaft can be shifted to the phase angle of the rotation drive of the other shaft, for example by 90° or 270°. With such a phase angle, it is possible, in particular, for the two shafts to deflect the filaments or filament bundles in the same transverse direction or in opposite transverse directions. It lies within the scope of the invention that the at least two shafts of the filament guide have the same or different rotation speeds. Basically it is possible for a plurality of pairs having two shafts each to be between the stretcher and the deposition device.

According to a preferred embodiment of the invention, the filament guide has two shafts at the same vertical level or substantially at the same vertical level between the stretcher and the deposition device. It lies within the scope of the invention that the two rotation axes of the shaft are in one horizontal plane or substantially in one horizontal plane.

According to one variant embodiment of the invention, the disks of one shaft, in the previously described embodiment, engage in spaces between the disks of the other shaft and vice versa. Therefore, the two shafts mesh with one another. It lies within the scope of the invention that, in this connection, one disk of one shaft and one disk of the other shaft form the side walls of a filament-guide gap. Advantageously, the filaments or filament bundles are guided through these filament-guide gaps and are deflected in the transverse direction by this filament-guide gap. According to another variant embodiment of the invention, the two shafts at the same vertical level or substantially at the same vertical level have such a spacing therebetween that the disks of the shafts do not engage in one another. The disks of the two shafts are therefore disengaged. Therefore, the spacing between the rotation axes of the two shafts can be dimensioned such that the disks fall just short of engagement and, therefore, the spacing between the outer edges of the disks is small or very small, as viewed in a projection. In the embodiments comprising at least two shafts disposed at the same vertical level or at substantially the same vertical level, the filaments or filament bundles emerging from the stretching chute are advantageously guided between the two rotation axes of the shafts in the center or substantially in the center.

Another embodiment of the invention is characterized in that at least two shafts—in particular two shafts—are at different vertical levels. It lies within the scope of the invention that the rotation axes of the shafts or the two shafts are offset from one another vertically and, in particular, are on opposite sides of the filament curtain emerging from the stretcher. In this embodiment of the invention, the rotation axes of the at least two shafts are at different horizontal levels. The two rotation axes of the shafts disposed at different levels can have the same spacing from the filament curtain or can have a different spacing from the filament curtain. According to one embodiment, one of the two shafts—in particular the lower of the two shafts to the flow direction of the filaments—can be provided with disks in a manner that differs from the other shaft. For example, disks can be provided in the edge regions of the lower shaft, while no shafts or only a few shafts are provided in the central region of this shaft. In this manner it is possible to manipulate or improve the deposition of the filaments at the edge of the spunbond web.

Another recommended embodiment of the invention is characterized in that at least one rotatable shaft, preferably a plurality of rotatable shafts, extend in the travel direction of the spunbond web or substantially in the travel direction of the spunbond web and that at least one disk extending longitudinally of the shaft is connected to each shaft. Advantageously, only one disk extending longitudinally of the shaft is connected to each shaft. Preferably these are disks having flat disk surfaces. It lies within the scope of the invention that the shaft or the shafts each execute a reciprocating rotation movement about the rotation axis thereof. The disks or disk surfaces of the individual shafts form the side wall or the side walls of a filament-guide gap or filament-guide gaps. Due to the reciprocating rotation movement of the shaft or the shafts, each disk is moved back and forth about a certain angular section and, advantageously, the disks also oscillate about the vertical position thereof.

Another preferred embodiment of the invention is characterized in that the filament guide has at least two guide parts extending transversely to the travel direction, each guide part having a plurality of filament-guide gaps lined up next to one another in a row transversely to the travel direction and wherein the two guide parts of the filament guide are moved back and forth in the travel direction such that substantially the filament-guide gap of one guide part and, subsequently, substantially the filament-guide gap of the other guide part are brought into or come into engagement with the filament curtain in alternation. The back and forth movement advantageously takes place as an oscillation or a symmetrical oscillation about a neutral position. Preferably, the filament-guide gaps of one guide part have a different design or orientation than the filament-guide gaps of the other guide part. It is recommended that the filament-guide gaps of the two guide parts have different orientations or inclinations of the respective plates. According to one variant embodiment, the side walls of the filament-guide gaps of one guide part are angled in a direction transverse to the travel direction of the spunbond web and the plates of the filament-guide gap of the other guide part are angled in the opposite direction transverse to the travel direction. The plates of the two guide parts are preferably offset from one another. According to one embodiment, the plates of the two guide parts are set at the same angle.

It lies within the scope of the invention that at least one guide surface extending transversely to the travel direction of the spunbond web is between the filament guide and the deposition device. Preferably, at least a subregion of this guide surface is angled toward the deposition device, thereby constricting the conveyance space for the filaments. Advantageously, this guide surface extends at least over the greatest portion of the width of the spunbond web. It lies within the scope of the invention that this is a flat guide surface that is angled toward the deposition device over the entire surface thereof.

One embodiment of the invention is characterized in that at least one guide surface extending transversely to the travel direction of the spunbond web is between the filament guide and the deposition device, which the guide surface is curved or bent and forms at least one constriction for the filament conveyance space. It is recommended that this at least one guide surface has at least one section that converges toward the deposition device and at least one section that diverges toward the deposition device. It lies within the scope of the invention that two curved guide surfaces that, in combination, form at least one constriction for the filament conveyance space are between the filament guide and the deposition device and have at least one converging region and at least one diverging region. In principle, however, only one curved guide surface can be provided between the stretcher and the deposition device. The at least one curved or bent guide surface preferably extends at least across the greatest portion of the width of the spunbond web.

It lies within the scope of the invention that the deposited filament or the deposited spunbond web are consolidated on the deposition device. Various consolidation measures are basically possible. In principle, the spunbond web can be subjected to thermal bonding and/or mechanical consolidation and/or chemical consolidation. According to one embodiment of the invention, the spunbond web is consolidated by at least one calender or is thermally bonded. According to another embodiment, as an alternative or in addition to calendering for consolidation the nonwoven web, hydrodynamic consolidation (hydroentanglement) and/or mechanical needling by a needling device can be carried out.

The object of the invention is also a spunbond fabric produced by the above-described apparatus and/or according to the above-described method. As compared to known spunbond fabrics—in particular as compared to known spunbond fabrics produced using the spunbond process, this spunbond fabric is characterized in that a markedly greater number of filament components is oriented transversely to the machine direction (CD).

The invention is based on the finding that spunbond fabrics having isotropic properties, i.e. having properties that are identical or substantially identical both in the machine direction (MD) and transversely to the machine direction (CD), can be generated by the apparatus according to the invention. This also applies, in particular, to spunbond fabrics having higher basis weights. In particular, identical nonwoven strengths can be achieved both in the machine direction (MD) and transverse to the machine direction (CD). Other properties of the spunbond fabric produced according to the invention, such as dimensional stability, tear propagation resistance, etc., are also characterized by optimal isotropy to the above-described directions. The invention is based on the discovery, in particular, that a desired transverse orientation can be very effectively imparted to the deposited filaments by the measures according to the invention, primarily by the filament guides according to the invention. This can be achieved within the scope of the invention in a manner that is functionally reliable, precise, and reproducible. The apparatus according to the invention is characterized by a simple design and a high level of operational reliability. Advantageously, the existing apparatus can be easily integrated into existing systems such that, advantageously, the devices already known from practical applications can be used, for example, to produce spunbond fabrics having high basis weights. The measures according to the invention are therefore also characterized by a high level of cost-effectiveness. Another essential feature of the apparatus according to the invention is the reliable guidance of the filaments or filament bundles in the filament guides, whereby an advantageous deposition of the filaments or filament bundles having transversely oriented components onto the deposition device is ensured. The guidance of the filaments by the at least one filament guide also makes it possible, above all, to precisely adjust the mechanical properties of a spunbond fabric in the machine direction and transversely to the machine direction, which the adjustment can also be easily reproduced. The apparatus according to the invention is characterized, overall, by considerable advantages.

BRIEF DESCRIPTION OF THE DRAWING

The invention is explained below in greater detail by reference to a drawing that depicts only one embodiment. In schematic depictions:

FIG. 2 is a perspective view of a guide part of a filament guide according to the invention, FIG. 3A is an enlarged detail from FIG. 1, FIG. 3B is another embodiment of the object according to FIG. 3A, FIG. 5 is a top sectional view of the structure of FIG. 4, FIG. 6 is another embodiment as in FIG. 3A, FIG. 7 is an additional embodiment as in FIG. 3A.

SPECIFIC DESCRIPTION OF THE INVENTION

Figure 1:
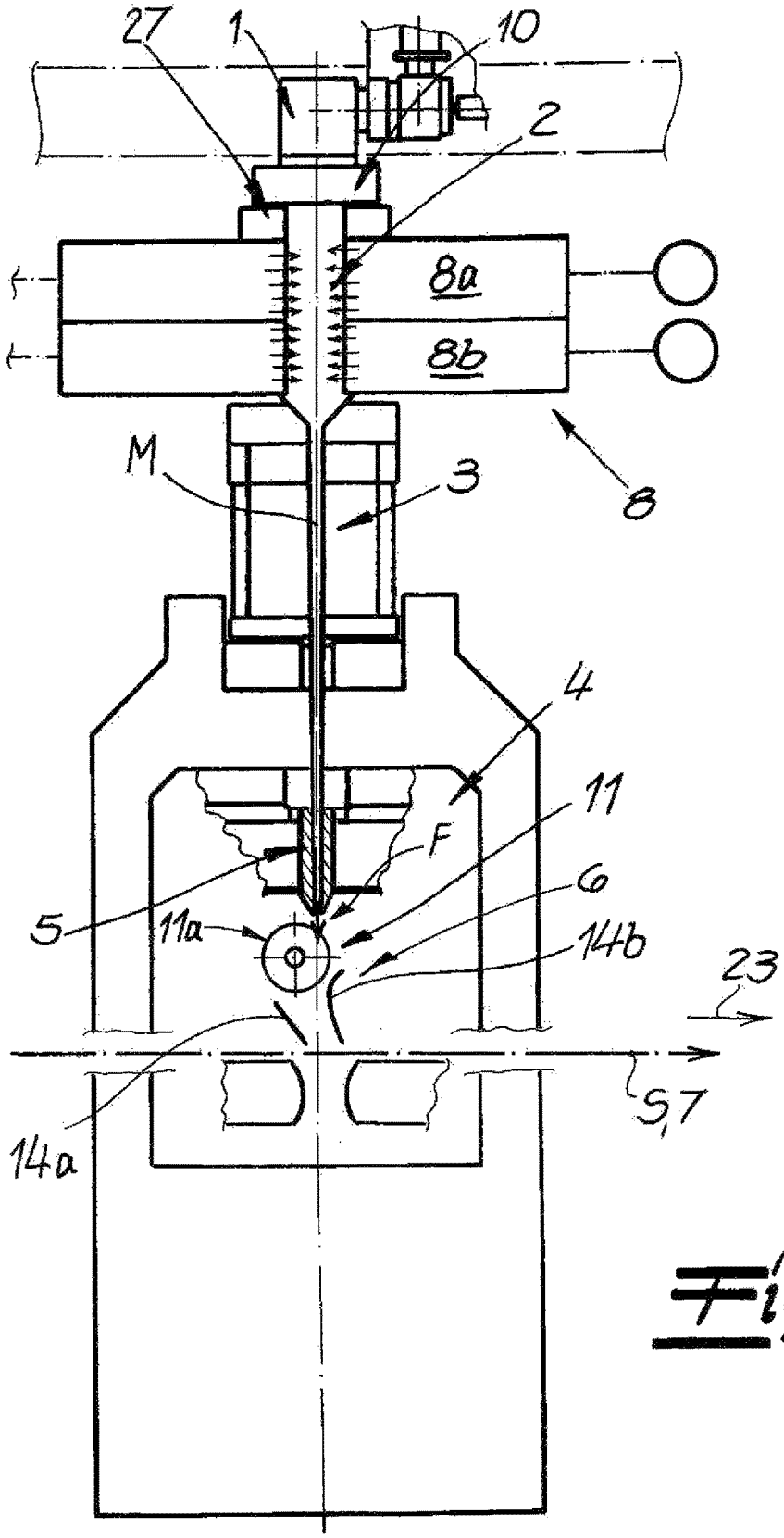
FIG. 1 is a vertical section through an apparatus according to the invention.

FIG. 1 shows an apparatus for the continuous manufacture of a spunbond web S from aerodynamically stretched filaments of thermoplastic plastic. The apparatus has a spinneret 1 and a cooling chamber 2 underneath the spinneret and into which process air can be introduced in order to cool the filaments. Adjoining the cooling chamber 2 is an intermediate passage 3 followed in the direction of travel of the filaments, by a stretcher 4 having a stretching passage 5. Adjoining the stretching passage 5 is a deposition unit 6. A deposition device as a continuously circulating conveyor belt 7 for the deposition of the filaments for the spunbond web S is provided underneath the deposition unit 6. Here, the assembly comprising the cooling chamber 2, the intermediate passage 3, and the stretcher 4—except for the air supply in the cooling chamber 2—is a closed system. A further air supply is therefore not provided in this assembly.

FIG. 1 also shows that an air supply chamber 8 next to the cooling chamber 2 and according to the embodiment is subdivided into an upper compartment 8*a* and a lower compartment 8*b*. Process air having different temperatures can be fed to the two compartments 8*a* and 8*b* and the filaments emerging from a nozzle plate 10 of the spinneret 1 are acted upon by this process air in the cooling chamber 2. Advantageously and in the embodiment according to FIG. 1, a monomer aspirator 27 is between the nozzle plate 10 and the cooling chamber 2 for extracting from the apparatus interfering gases emerging during the spinning process.

It is also evident in FIG. 1 that the intermediate passage 3 has downstream converging walls, as viewed in the vertical section, from the outlet of the cooling chamber 2 to the inlet into the stretching passage 5 of the stretcher 4 and, in fact, advantageously and here, to the inlet width of the stretching passage 5. The stretcher 4 or the stretching passage 5 has for the filaments a stretching chute that extends transversely to the travel direction 23 of the spunbond web S and, in fact, advantageously at least across the greatest portion of the width of the deposited spunbond web S. A filament curtain F comprising the filaments emerges from the stretching chute and also extends transversely to the travel direction 23 of the spunbond web S.

A filament guide 11 is between the stretcher 4 or between the stretching passage 5 and the conveyor belt 7, as shown in FIG. 1. According to one embodiment and in the embodiment according to FIG. 1, the filament guide 11 has a guide part 11*a* having a rotating shaft 16 explained in greater detail below. The filaments emerging from the stretching chute of the stretcher 4 as the filament curtain F are deflected transversely to the travel direction 23 of the conveyor belt 7 by the filament guide or by the shaft 16. Due to this deflection by the filament guide 11, the filaments undergo an additional transverse spreading (transversely to the machine direction) when deposited on the conveyor belt 7.

In the embodiment according to FIG. 1, a deposition unit 6 having two guide surfaces 14*a* and 14*b* is underneath the filament guide 11. These guide surfaces 14*a* and 14*b* extend, advantageously and here, transverse to the travel direction 23 of the spunbond web S and, in fact, preferably along at least the greatest portion of the width of the spunbond web S. In the embodiment according to FIG. 1, the left guide surface 14*a* is flat and is angled toward the conveyor belt 7. The right guide surface 14*b*, however, is curved and has an upper section that converges toward a middle plane M, as well as a lower section that diverges away from the middle plane M. The deposition unit 6 according to FIG. 1 is also shown in FIG. 3A.

Figure 3C:
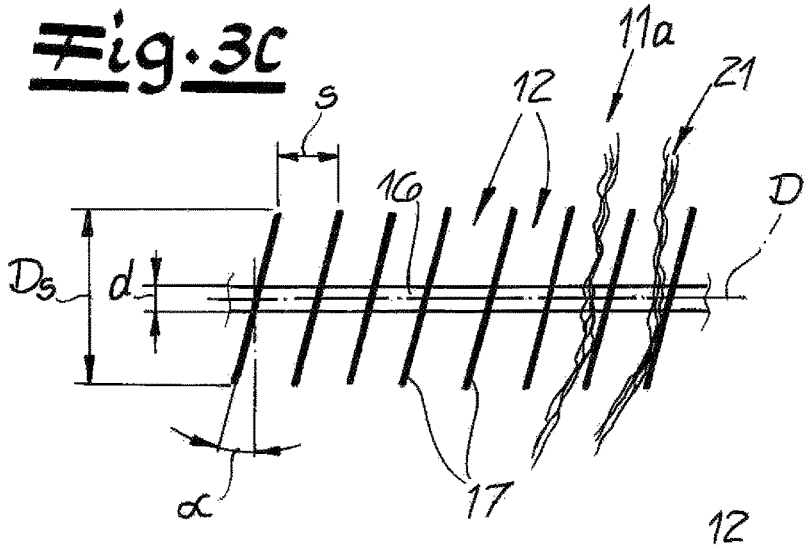
FIG. 3C is a section through the guide part from FIG. 2 in a first position.
Figure 3D:
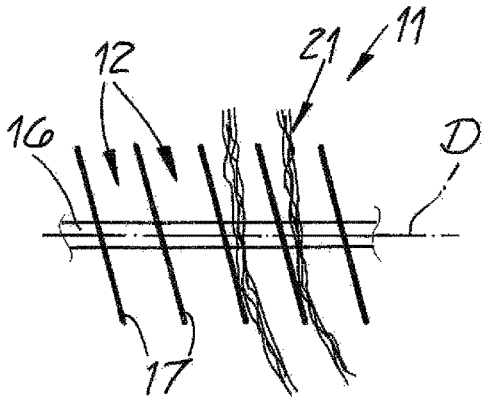
FIG. 3D is a view like FIG. 3C but in a second position.

FIG. 2 is a perspective view of a guide part 11*a* of the filament guide 11 having the rotating shaft 16. In the embodiment according to FIGS. 1, 3A and 3B, the filament guide 11 has only one such guide part 11*a*. In this connection, the rotation axis D of the shaft 16 is offset in each case to the left to the middle plane M or to the filament curtain F. According to a highly preferred embodiment and here, the shaft 16 carries a row of circular disks 17 that are fixed on the shaft 16. The disks 17 extend at a slant to the rotation axis D of the shaft and, preferably and here, are parallel to one another. Filament-guide gaps 12 for guiding or deflecting the filaments of the filament curtain F are formed between the disks 17. The filament-guide gaps 12 have upstream openings 13. When the shaft 16 rotates, these upstream openings 13 of the filament-guide gaps 12 shift transversely to the travel direction 23 of the spunbond web S. This can be seen, in particular, by comparing FIGS. 3C and 3D. When the shaft 16 rotates, filament bundles 21 each comprising a plurality of filaments are separated from of the filament curtain F. In this connection, each filament bundle 21 is advantageously accommodated entirely within a respective filament-guide gap 12 between the respective two disks 17. The filament bundles 21 in the filament-guide gaps 12 are shown in FIGS. 3C and 3D. The filament bundles 21 are deflected transversely to the travel direction 23 of the spunbond web S. The position of the shaft 16 in FIG. 3D differs from the position according to FIG. 3C in that the shaft 16 was rotated further by one-half of one rotation. As can be seen by comparing FIGS. 3C and 3D, the filament bundles 21 are deflected transversely to the travel direction 23 alternatingly in opposite directions when the shaft 16 rotates. When the shaft 16 rotates, a neutral position is also passed through in which the filament bundles 21 land on the conveyor belt 7 at the middle plane M without being deflected or substantially without being deflected. The rotation of the shaft 16 can therefore also be detected as an oscillation about the above-described neutral position. As explained above, when the shaft 16 moves or rotates, the filament-guide gap 12 or the upstream openings 13 thereof are displaced transversely to the travel direction 23 of the spunbond web S such that a transverse spreading to the travel direction 23 is imparted to the filaments or filament bundles 21 guided through the filament-guide gap 12 when they are deposited on the deposition device or on the conveyor belt 7. The shaft 16 has a diameter d and the disks 17 have a diameter $D_s$ in projection. In addition, the disks 17 are inclined at an angle $\alpha$ to the rotation axis D of the shaft 16. Preferably and here, the disks 17 connected to the shaft 16 are parallel to one another with spacing s on both sides.

FIGS. 3A and 3B show an embodiment in which the filament guide 11 according to the invention has only one guide part 11*a* having only one rotating shaft 16. As described above, the shaft 16 or the rotation axis D of the shaft 16 is offset from the middle plane M or offset from the filament curtain F. In fact, the rotation axis D has a spacing 1 from the middle plane M. The end of the stretching chute of the stretching passage 5 is set at a spacing a from the conveyor belt 7 and the rotation axis D of the shaft 16 is at a spacing b from the conveyor belt 7. FIG. 3A shows the above-described deposition unit 6 of the embodiment according to FIG. 1. FIG. 3B, however, shows another deposition unit 6 having only one guide surface 14*b* whose cross-section is part-cylindrical and that also extends transversely to the travel direction 23 of the spunbond web S.

Figure 4:
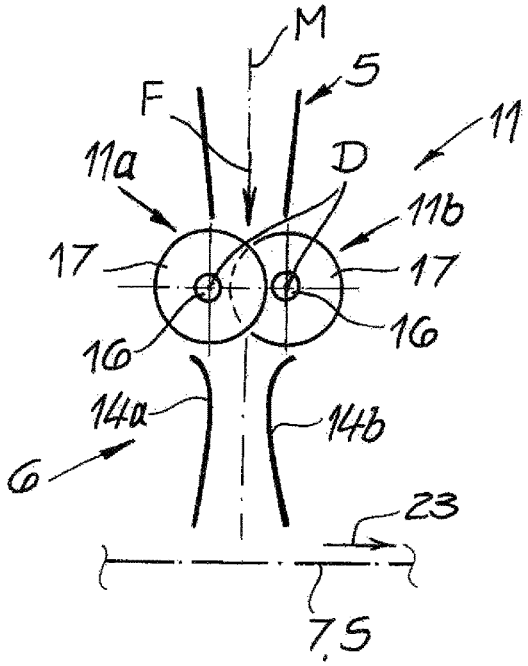
FIG. 4 is another embodiment of the detail of FIG. 3A.

FIG. 4 shows another embodiment of a filament guide 11 according to the invention. Two guide parts 11*a* and 11*b* are provided here, each of which has a rotating shaft 16 extending transversely to the travel direction of the spunbond web S. The rotation axes D of the two shafts 16 are at the same vertical level here. In this embodiment, the disks 17 of one shaft 16 engage into spaces between the disks of the other shaft 16. This is shown particularly clearly in the top view according to FIG. 5. A filament-guide gap 12 is formed here between each disk 17 of one shaft 16 and a respective disk 17 of the other shaft 16. In this embodiment, the disks 17 of the shafts 16 mesh with one another. The two shafts 16 can rotate in the same or the opposite direction. The rotation can be clockwise or counterclockwise. In this embodiment (FIG. 4) and in the embodiments according to FIGS. 6 and 7 described below, the deposition unit 6 is a diffuser. In this connection, preferably and here, two guide surfaces 14*a* and 14*b* curved symmetrically to the middle plane M are provided between the filament guide 11 and the conveyor belt 7. These curved guide surfaces 14*a* and 14*b* form an upper converging region and a constriction adjacent thereto, as well as a subsequent region diverging toward the conveyor belt 7.

The embodiment according to FIG. 6 also has two guide parts 11*a* and 11*b* that each have a rotating shaft 16. Here, the two shafts 16 or the rotation axes D thereof are spaced such the disks 17 of one shaft 16 do not engage into spaces between the disks of the other shaft. The filaments are guided between the rotation axes D of the two shafts 16.

In the embodiment according to FIG. 7, two rotating shafts 16 or the rotation axes D thereof are at different vertical levels or the rotation axes D are in different horizontal planes. Both shafts are also offset from the middle plane M or from the filament curtain F and the filaments are guided between the rotation axes D of the two shafts 16. In the embodiments according to FIG. 6 and FIG. 7 as well, the two shafts can rotate in the same direction or in opposite directions. The rotation can be clockwise or counterclockwise.

Figure 8A:
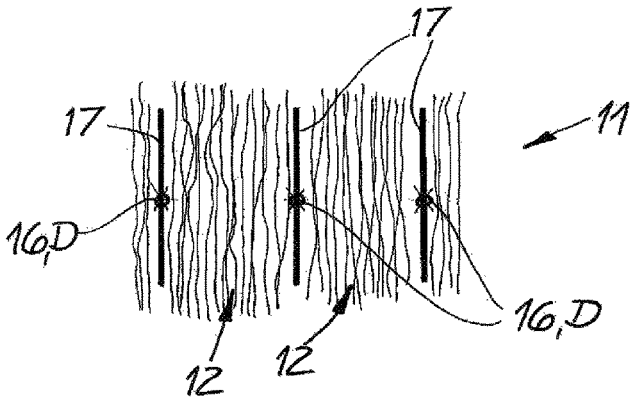
FIG. 8A is a section through another embodiment of a filament guide according to the invention.
Figure 8B:
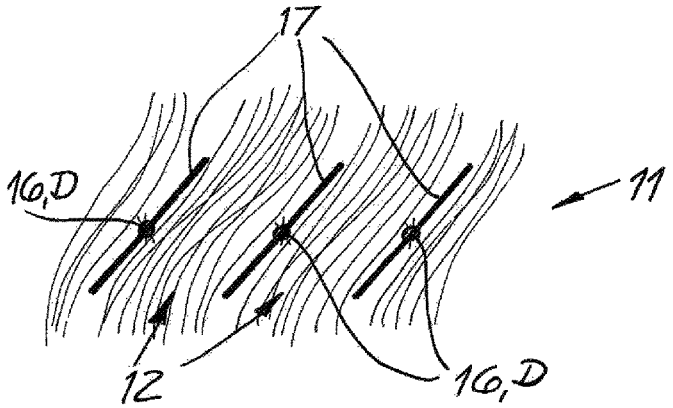
FIG. 8B is the structure of FIG. 8A in another position.

FIGS. 8A and 8B show an alternative embodiment of a filament guide 11 according to the invention. The filament guide 11 here has a plurality of rotating shafts 16 extending in the travel direction 23 of the spunbond web S. A disk 17 extending longitudinally of the shaft is connected to each shaft 16. Preferably and here, the shafts 16 each rotate back and forth through a predetermined angle about the respective rotation axis D. As a result, the filament-guide gaps 12 or the upstream openings 13 thereof between the disks 17 are displaced transversely to the travel direction 23 of the spunbond web S. Due to this displacement, the filaments or filament bundles 21 of the filament curtain F are deflected transversely to the travel direction 23 of the spunbond web S. This can be seen by comparing FIGS. 8A and 8B. FIG. 8A shows a neutral position of the shafts 16 or the disks 17 thereof. The disks 17 oscillate about this neutral position and, as a result of these oscillations or back-and-forth rotation movements, the filaments are deflected transversely to the travel direction 23.

Figure 9:
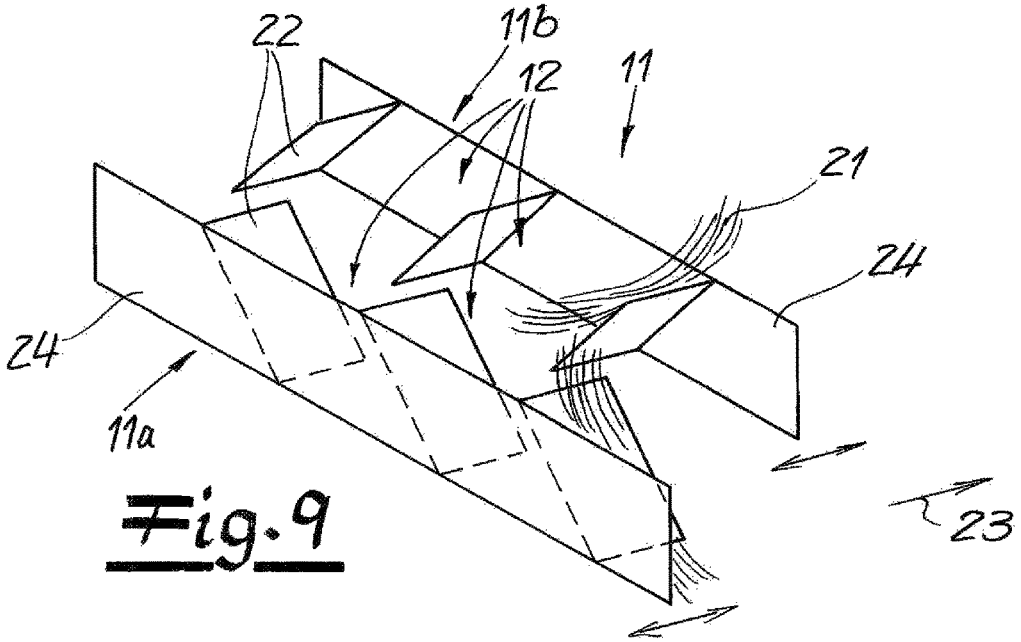
FIG. 9 is a perspective view of an additional embodiment of a filament guide according to the invention.

In the embodiment shown in FIG. 9, the filament guide 11 has two guide parts 11*a* and 11*b* extending transverse to the travel direction 23 of the spunbond web S and each having a plurality of filament-guide gaps 12 aligned in a row transversely to the travel direction 23. These filament-guide gaps 12 are formed between plates 22 that are angled to the filament curtain F or to the middle plane M and that are connected to guide bars 24 oriented transverse to the travel direction 23. The plates 22 of the two guide parts 11*a* and 11*b* are angled in opposite directions or are at a slant or are oriented so as to be offset from one another. The two guide parts 11*a* and 11*b* are moved back and forth in the travel direction 23 such that the filament-guide gap 12 of one guide part 11*a* and the filament-guide gap 12 of the other guide part 11*b* alternately engage with the filament curtain F. In turn, filament bundles 21 are separated from the filament curtain F and are deflected transversely to the travel direction 23. These guide parts 11*a* and 11*b* also move or oscillate about a neutral position in which there is no deflection or substantially no deflection of the filaments or filament bundles 21. The back-and-forth movement or oscillation of the guide parts 11*a*, 11*b* alternately deflects the filament bundles 21 in one direction or in the direction opposite thereto, transversely to the travel direction 23.

The invention is explained in greater detail below with reference to the embodiments:

The table lists parameters and measurement results for embodiments 1 to 4 according to the teaching according to the invention and by comparison with comparative examples V1 and V2 without the filament guide 11 according to the invention. An apparatus according to FIG. 1 was used in every case, where the individual embodiments or comparative examples differ merely in terms of the design of the filament guide unit 11 and the deposition unit 6 between the stretcher 4 and the conveyor belt 7. In embodiments 1 to 3, the region between the stretcher 4 and the conveyor belt 7 was designed as shown in FIG. 3B. Here, a shaft 16 offset from the middle plane M is provided and there is a curved guide surface 14*b* offset from the middle plane M. In embodiment 4, the region between the stretcher 4 and the conveyor belt 7 is designed according to FIG. 3A. Here, a shaft 16 disposed so as to be offset and two guide surfaces 14*a*, 14*b* (according to FIG. 3A) located thereunder were therefore provided. In the comparative example V2, work was performed with the deposition unit 6—i.e. with the guide surfaces 14*a* and 14*b*-according to FIG. 3A, but without the shaft 16. In the comparative example V1, a so-called REICOFIL IV diffuser was inserted between the stretcher 4 and the conveyor belt 7, wherein the diffuser is shown in FIG. 3 of EP 1 340 843 [U.S. Pat. No. 6,918,580]. Work was carried out without a filament guide 11 or a shaft 16 here as well.

The second column of the table lists the basis weight, in $g/m^2$, of the spunbond web that is obtained and the third column of the table lists the line speed or the conveyance speed of the spunbond web S in m/min. The fourth column of the table lists the thermoplastic plastic or raw material that is used for the filaments or for the manufacture of the spunbond web S, i.e. polypropylene with the associated melt flow rate MFR for the embodiments 1 to 3 and for the comparative examples V1 and V2. Bicomponent filaments having a core-sheath configuration were used in embodiment 4 where the core comprised polyethylene terephthalate (PET) and the sheath comprised a copolymer of PET. The other columns of the table list the spacing a between the end of the stretcher 4 and the conveyor belt 7, the spacing b between the rotation axis D of the shaft 16, the conveyor belt 7, and the spacing I of the rotation axis D from the middle plane M. The subsequent columns list the diameter d of the shaft 16 that is used, as well as the diameters $D_s$ of the disks 17 in the projection and the spacing s between the disks, as well as the angle $\alpha$ that the disks 17 form with the rotation axis D. The subsequent columns show the tensile strength in the machine direction (MD) in N/5 cm and the tensile strength transverse to the machine direction (CD) in N/5 cm for the individual examples. The tensile strengths were measured according to EDANA 20.2-89. This is followed by a column listing the corresponding MD/CD ratio. The two final columns relate to the rotating shaft 16. The second-to-last column lists the rotation speed of the shaft and the final column lists the type of drive for the shaft 16. In embodiments 1 to 3 the rotating shaft 16 was driven merely by the flowing process air. In embodiment 4, however, an electric motor was used to drive the shaft 16. It is understood that no parameters or information related to the shaft 16 are provided in the comparative examples V1 to V2, since neither a filament guide 11 nor a shaft 16 were used here, as is known.

A comparison of the embodiments 1 to 4, which were carried out with the filament guide 11 according to the teaching according to the invention, with the comparative examples V1 and V2 (without the filament guide 11), shows that, as compared to the comparative examples, the spunbond webs S produced according to the invention have an improved tensile strength in the transverse direction (CD), in particular, to the basis weight thereof. The spunbond webs S produced according to the invention are therefore characterized by considerable advantages. With regard to the comparative examples, it should be noted that the spunbond web according to comparative example V1, which was produced without the shaft, has filaments that were deposited in a relatively uniform or homogeneous manner and is also characterized by relatively favorable strength values, even if these strength values—in particular to the basis weight of the spunbond fabric—are not as optimal as they are with the spunbond webs produced according to the invention. In the comparative example V2—without the Reicofil 4 diffuser—the filaments are deposited in a relatively nonuniform manner, however, and markedly lower strength values are obtained.

| No. | Basis weight | Line speed | Raw material | a | b | l | d | $D_a$ | Alpha | s |
|---|---|---|---|---|---|---|---|---|---|---|
| 1 | 55 gsm | 50 m/min. | PP MFR 19 | 1600 mm | 1200 mm | 120 mm | 100 mm | 300 mm | 30° | 100 mm |
| 2 | 55 gsm | 50 m/min. | PP MFR 19 | 1600 mm | 1200 mm | 100 mm | 100 mm | 300 mm | 30° | 100 mm |
| 3 | 55 gsm | 50 m/min. | PP MFR 19 | 1600 mm | 1200 mm | 75 mm | 100 mm | 300 mm | 30° | 100 mm |
| 4 | 100 gsm | 47 m/min. | Pet/ CoPET core/ sheath IV 0.63 | 800 mm | 500 mm | 150 mm | 200 mm | 400 mm | 25° | 100 mm |
| V1 | 65 gsm | 51 m/min. | PP MFR 25 | | | no shaft 16 | | | | |
| V2 | 65 gsm | 48 m/min. | PP MFR 19 | | | no shaft 16 | | | | |

| No. | Number of guide surfaces | N/5 cm in MD | N/5 cm in CD | MD/CD | Shaft speed | Drive type |
|---|---|---|---|---|---|---|
| 1 | 1 | 187 | 164 | 1.14 | 1030 | air |
| 2 | 1 | 176 | 162 | 1.09 | 1150 | air |
| 3 | 1 | 146 | 188 | 0.78 | 1111 | air |
| 4 | 2 | 291 | 357 | 0.82 | 1200 | active/ e-motor |
| V1 | Reicofil 4 diffuser | 195 | 162 | 1.21 | — | — |
| V2 | 2 | 174 | 143 | 1.22 | — | — |

The invention claimed is:

1. An apparatus for the continuous manufacture of a spunbond web from aerodynamically stretched filaments of thermoplastic plastic, the apparatus comprising:

at least one spinneret emitting the filaments, a cooling chamber for cooling the filaments emitted by the spinneret, a stretcher for stretching the cooled filaments and forming with the cooling chamber a closed system, a deposition device for depositing the stretched filaments to form the spunbond web and transporting the spunbond web in a travel direction, at least one filament guide having a plurality of filament-guide gaps having stretcher side openings open toward the stretcher and provided between the stretcher and the deposition device such that the filaments emerging from the stretcher are divided into filament bundles by the filament guide or by the at least one guide part of the filament guide and pass through the filament guide-gaps or through the stretcher-side openings of the filament-guide gaps, and means for moving the filament guide or at least one guide part thereof such that the filament-guide gaps or the stretcher-side openings thereof are displaced transversely to the travel direction of the spunbond web and the filament bundles guided along or through the filament-guide gaps are given a transverse orientation to the travel direction of the spunbond web when deposited by the deposition device.

2. The apparatus according to claim 1, wherein the means moves the filament guide or the at least one guide part of the filament guide in a periodic manner.

3. The apparatus according to claim 1, wherein the filament guide has at least one rotatable or rotating shaft, at least one disk adjoins the shaft, the disk forms a side wall of at least one of the filament-guide gaps.

4. The apparatus according to claim 1, wherein the filament guide has at least one rotatable or rotating shaft extending transversely to the travel direction of the spunbond web, a plurality of disks is connected to the shaft, the filament-guide gaps are formed between the disks, and vertical lines extending from different points of an outer circumference or outer region of a one of the disks to a rotation axis of the shaft have different intersection points with a rotation axis of the shaft.

5. The apparatus according to claim 4, wherein at least one portion of all of the disks of the shaft or a majority of the disk surface of these disks is/are at a slant or tilted to the rotation axis of the shaft.

6. The apparatus according to claim 3, wherein at least one deflection of the filament bundles transversely to the travel direction of the spunbond web takes place with each revolution of the shaft.

7. The apparatus according to claim 3, wherein a rotation speed of the shaft can be adjusted and a frequency of deflections of the filament bundles can be adjusted by adjusting the rotation speed of the shaft.

8. An apparatus for the continuous manufacture of a spunbond web from aerodynamically stretched filaments of thermoplastic plastic, the apparatus comprising:

at least one spinneret emitting the filaments, a cooling chamber for cooling the filaments emitted by the spinneret, a stretcher for stretching the cooled filaments, a deposition device for depositing the stretched filaments to form the spunbond web and transporting the spunbond web in a travel direction, at least one filament guide having a plurality of filament-guide gaps having stretcher side openings open toward the stretcher and provided between the stretcher and the deposition device, the filament guide having at least two rotatable or rotating shafts extending transversely to the travel direction of the spunbond web and a plurality of disks connected to each shaft, and means for moving the filament guide or the at least two rotatable or rotating shafts thereof such that the filament-guide gaps or the stretcher-side openings thereof are displaced transversely to the travel direction of the spunbond web and filament bundles guided along or through the filament-guide gaps are given a transverse orientation to the travel direction of the spunbond web when deposited by the deposition device.

9. The apparatus according to claim 8, wherein the two shafts are at the same vertical level or substantially at the same vertical level and the disks of one shaft engage into spaces between the disks on the other shaft, and vice versa.

10. The apparatus according to claim 8, wherein the at least two shafts are at different vertical levels and rotation axes of the shafts are offset from one another vertically on opposite sides of a filament curtain emerging from the stretcher.

11. An apparatus for the continuous manufacture of a spunbond web from aerodynamically stretched filaments of thermoplastic plastic, the apparatus comprising:

at least one spinneret emitting the filaments, a cooling chamber for cooling the filaments emitted by the spinneret, a stretcher for stretching the cooled filaments, a deposition device for depositing the stretched filaments to form the spunbond web and transporting the spunbond web in a travel direction, at least one filament guide having a plurality of filament-guide gaps having stretcher side openings open toward the stretcher and provided between the stretcher and the deposition device, the guide having at least one shaft rotatable about a rotation axis and extending in the travel direction of the spunbond web, and at least one disk extending longitudinally of the shaft is connected to each shaft, the at least one shaft being reciprocal along and rotatable about the rotation axis, and means for moving the filament guide or the at least one shaft thereof such that the filament-guide gaps or the stretcher-side openings thereof are displaced transversely to the travel direction of the spunbond web and filament bundles guided along or through the filament-guide gaps are given a transverse orientation to the travel direction of the spunbond web when deposited by the deposition device.

12. An apparatus for the continuous manufacture of a spunbond web from aerodynamically stretched filaments of thermoplastic plastic, the apparatus comprising:

at least one spinneret emitting the filaments, a cooling chamber for cooling the filaments emitted by the spinneret, a stretcher for stretching the cooled filaments, a deposition device for depositing the stretched filaments to form the spunbond web and transporting the spunbond web in a travel direction, at least one filament guide having a plurality of filament-guide gaps having stretcher side openings open toward the stretcher and provided between the stretcher and the deposition device, the filament guide having at least two guide parts extending transversely to the travel direction of the spunbond web and each forming a plurality of the filament-guide gaps aligned in a row transversely to the travel direction of the spunbond web, the filament-guide gaps of one of the guide parts being different from the filament-guide gaps of the other guide part, the two guide parts being movable back and forth in the travel direction of the spunbond web such that the filament-guide gaps of the one guide part and the filament-guide gaps of the other guide part are brought into or come into engagement with a filament curtain issuing from the stretcher in alternation, and means for moving the filament guide or the at least two guide parts thereof such that the filament-guide gaps or the stretcher-side openings thereof are displaced transversely to the travel direction of the spunbond web and filament bundles guided along or through the filament-guide gaps are given a transverse orientation to the travel direction of the spunbond web when deposited by the deposition device.

13. The apparatus according to claim 12, wherein the filament-guide gaps of the two guide parts are formed by plates and differ in terms of orientation and, inclination of the plates thereof.

14. The apparatus according to claim 1, wherein at least one guide surface extending transversely to the travel direction of the spunbond web is between the filament guide and the deposition device and at least one subregion of the guide surface is angled toward the deposition device.

15. The apparatus according to claim 1, wherein at least one guide surface extending transversely to the travel direction of the spunbond web is between the filament guide and the deposition device and is curved so as to form at least one constriction for conveying the filament bundles.

16. An apparatus for the continuous manufacture of a spunbond web and comprising:

a spinneret downwardly emitting continuous filaments;

a cooling chamber below the spinneret for cooling the filaments;

a stretcher below the cooling chamber for aerodynamically stretching the cooled filaments and forming them into a curtain elongated horizontally in a transverse and horizontal direction;

a conveyor surface downstream of the stretcher for receiving and conveying the stretched and cooled filaments in a horizontal and longitudinal travel direction generally perpendicular to the curtain away from the stretcher;

a guide above the conveyor surface and below the stretcher and having a plurality of guide parts subdividing the curtain into a plurality of transversely spaced bundles; and means connected to the guide parts for transversely reciprocating the bundles so as to deposit the filaments transversely to the travel direction on the surface.

17. The apparatus defined in claim 16, wherein the guide includes:

a shaft extending on an axis horizontally and transversely generally parallel to the curtain but offset in the travel direction therefrom, and a plurality of circular and planar disks forming the guide parts, fixed on the shaft, spaced transversely therealong, and lying in respective planes extending at an acute angle to the axis, the planes being generally parallel.

* * * * *